United States Patent [19]

Martin

[11] Patent Number: 4,723,702

[45] Date of Patent: Feb. 9, 1988

[54] ONE-WAY NEWSPAPER DELIVERY RECEPTACLE

[76] Inventor: Travis B. Martin, 302 County Rd. 620-RD 3, West Salem, Ohio 44287

[21] Appl. No.: 526,603

[22] Filed: Aug. 26, 1983

[51] Int. Cl.[4] ..... B65D 91/00

[52] U.S. Cl. ..... 232/1 C; 232/17

[58] Field of Search ..... 232/1 C, 17, 22, 45

[56] References Cited

U.S. PATENT DOCUMENTS

| | | | |
|---|---|---|---|
| 882,381 | 3/1908 | Haentze | 232/17 |
| 1,810,769 | 6/1931 | Jaden | 232/17 |
| 3,144,984 | 8/1964 | Ross | 232/1 C |
| 3,960,316 | 6/1976 | Echterling | 232/1 C |
| 4,190,192 | 2/1980 | Cornwell, Jr. et al. | 232/17 |

*Primary Examiner*—Robert P. Swiatek
*Assistant Examiner*—David L. Tarnoff
*Attorney, Agent, or Firm*—Albert L. Ely, Jr.

[57] ABSTRACT

Newspaper retaining closure used in combination with an open-ended newspaper delivery receptacle. The closure is pivoted in the upper portion of the receptacle near its open end; it has a length greater than the vertical distance from the pivot to the bottom of the receptacle and extends inwardly of the receptacle, whereby the closure is lifted as a newspaper is inserted but partly closes the open end of the receptacle after the newspaper is inserted. The frontal area of the closure is insufficient to allow it to be lifted inwardly by normal winds and drafts.

5 Claims, 3 Drawing Figures

31
11
30
10
20
16
15
14
13
14
N
17
16

22
24
23
25
27
26
25
22
21

20
22
21
23
25
15
30
27
26
25
30
22
15
24

ONE-WAY NEWSPAPER DELIVERY RECEPTACLE

This invention relates to improvements in a newspaper delivery receptacle, particularly those used in suburban and rural areas and which are mounted on a suitable post near the berm of a road or highway.

Such receptacles are essentially tubes, once circular in cross-section but now usually rectangular in cross-section to provide a more secure base for mounting on a post or bracket arm as the need for a larger cross-sectional area has followed from the increase in size of newspapers of large and small cities which are published daily and delivered in rural and suburban areas. The rear ends of such tubes are closed but the front end, facing the berm, are open in order to permit ready insertion by the operator of, or an assistant riding in, a newspaper delivery car or truck driven along the berm. Any door or latching closure at the front end of the newspaper tube was economically impractical because of the time (and consequent delivery cost) required to insert the newspaper, especially if the closure should be jammed or stuck, as by the freezing of rain from which the newspaper was intended to be protected.

In order to afford some degree of protection from the weather, many newspaper publishers or subscribers use delivery receptacles as shown, for example, in U.S. Pat. Nos. 3,556,393 or 4,120,446. The open end of such a rectangular tube is shaped to provide an overhanging eave in the upper surface constituting the flat roof of the tube having front side edges which slant down to a floor provided with ridges which support the newspaper above drainholes for rain and snow driven into the open end. Such a receptacle having a length substantially greater than the length of a folded and rolled newspaper fully inserted therein, provided a fair degree of protection from the weather if and when the newspaper is fully inserted against the closed end of the tube. To provide a somewhat greater degree of protection, it has been proposed to equip a receptacle as described above with a flexible flap secured, as in U.S. Pat. No. 3,144,984, to the over-hanging eave in order to close off the open end of the tube.

Unfortunately, none of the above expedients meet a problem that is extremely annoying to newspaper subscribers and is, also, a source of disputes between the subscribers and the publisher or the deliverer regarding mis-delivered and scattered papers. Such disputes frequently result in the cancellation of subscriptions— a matter of great concern to the publisher whose advertising rates are based upon the guaranteed circulation of the newspaper. This problem is primarily due to the fact that cars and trucks, even when driven at a relatively moderate speed and at a substantial distance from the open end of a newspaper delivery receptacle, create turbulences, i.e., puffs and drafts, of air which blow or pull the newspaper out of the receptacle. Thereafter, even if the newspaper was wrapped or tied in its folded and rolled condition when inserted, the newspaper is likely to be soiled and, worse, litter the subscriber's and adjacent premises as well as the roadside due to the breaking of any wrapper or tie when the newspaper hits the ground.

An object and advantage of this invention is that a newspaper can be readily inserted in the receptacle and, when sufficiently inserted, not only is the newspaper prevented from being pulled out by the turbulence of air created by passing cars and trucks, but the deliverer is signaled that the newspaper has been properly inserted. Also, the newspaper is provided with greater protection from the weather. Still further, a substantial advantage of the invention is that it permits an easy modification and enhancement of conventional and heretofore unsatisfactory newspaper receptacles.

Other and further advantages of this invention will be apparent from the following specification, claims, and drawings in which:

Figure 1:
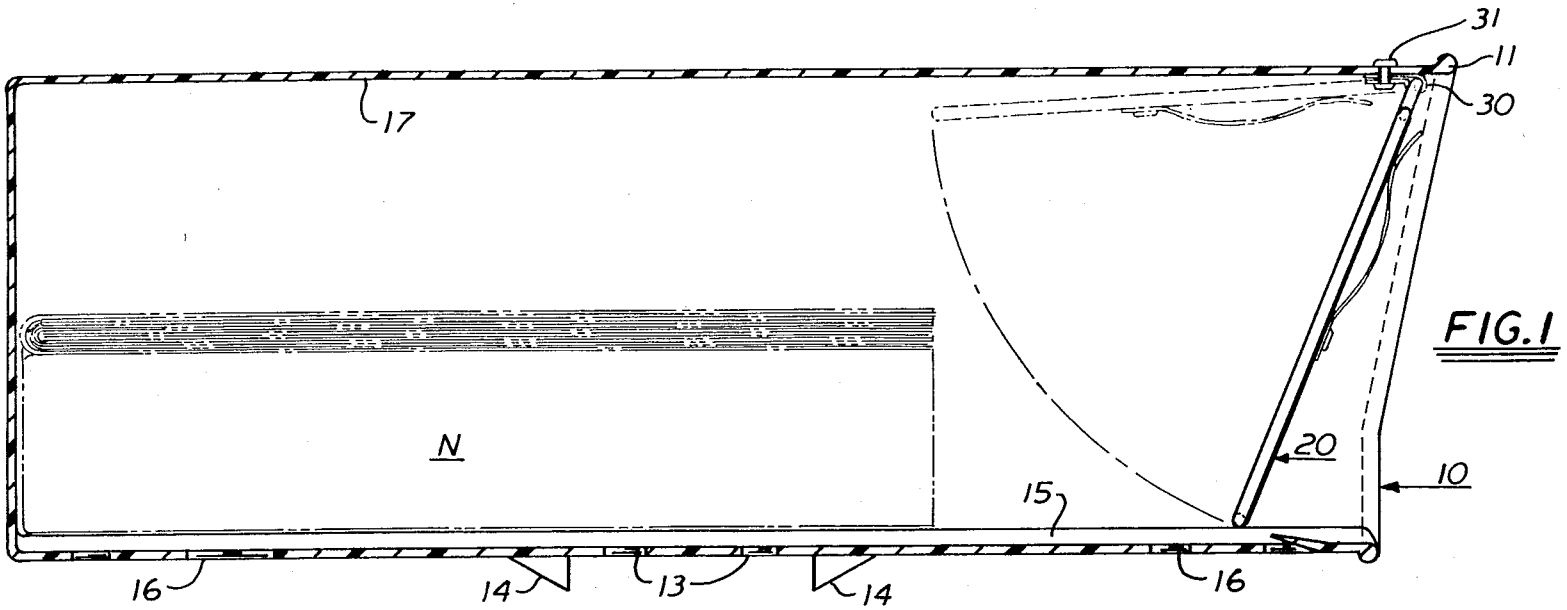
FIG. 1 is a longitudinal cross-section of an embodiment of this invention.

Refering to the drawings, the newspaper receptacle is preferably comprised of a conventional tube or box 10 of the type shown in the above U.S. Pat. Nos. 3,556,393 or 4,120,446. It is preferably formed from a suitable plastic, as indicated, or other corrosion-resistant material. The open front end has an overhanging eave portion 11 and the opposite end is closed. The bottom of the floor 12 of the box 10 is provided with bolt holes 13 which, together with the flanges 14, allow the box 10 to securely be mounted on a suitable post bracket or arm (not shown) so that the floor 12 is approximately horizontal. The floor is provided with ridges 15 which, in addition to stiffening the floor, support a newspaper N above rain-water or wet snow which can be driven into the box. Such rain-water and snow (when melted) can drain through holes or slots 16 in the floor 12.

A gate 20 is freely pivotally mounted to the underside of the roof 17 of the box 10 closely adjacent to the oven-hanging eave portion 11. The gate 20, in its preferred embodiment disclosed in the drawings, is comprised of a bent wire frame 21 having parallel sides 22 joined together by a bottom portion 23 and a top portion 24. The top portion 24 is bent to provide a pair of up-standing hinge tabs 25. The space between the sides 22 of the frame 21 is closed, preferably only partly, by a central panel 26 secured to the top and bottom portions of the frame 21. A spring strap 27 is preferably secured at one end to the panel 26.

To mount the gate 20 in the roof 17, a pair of hinge clips 30 are preferably employed. These clips are preferably pre-formed in a general U-shape but with an enlarged portion at the bottom of a U so that, when the wings of the clip (each preferably drilled to provide a hole for a fastener) are brought together with their holes in alignment, the bulbous portion thereby provided at the bottom of the U serves as a bearing in which the wire of a hinge tab 25 is loosely journaled. By then drilling the over-hanging eave portion 11 so that the drilled holes will align with holes in the wings of the hinge clips 30 and with the bottom of the gate 20 located farther in the box 10, each hinge clip 30 may be secured by a suitable fastener, preferably, for permanence, a "pop" rivet 31, as shown in FIG. 1.

The interior length of the floor 12 of a box 10 is conventionally greater in length than a folded newspaper by an amount equal to or somewhat greater than the interior height of the box (which is conventionally approximately equal to slightly greater than half the length of a folded and rolled newspaper). The conventional purpose of such interior length of the box 10 is to allow the over-hanging eave and slanting sides of the open end of the box to provide a degree of protection from the weather to a newspaper within the box when the newspaper, as it should be, is fully inserted against the back of the box.

In this invention, the height of the gate 20, from the pivotal center line of the hinge tabs 25 to the bottom edge of the gate is at least equal to and slightly greater than the interior height of the box from the top of the floor ridges 15 to the underside of the roof 17. Thus, with the gate 20 secured to the roof 17 by the hinge clips 30 adjacent the forward edge of the over-hanging eave 11, the gate 20 is free to fall by gravity against the floor, ridges 15 to a nearly but not fully vertical position (i.e., the maximum angle between the plane of the horizontal roof 17 and the plane of the hinged gate 20 is slightly acute). However, by mounting the gate 20 adjacent the forward edge of the eave 11, the gate can be swung inwardly to nearly a horizontal position with ample clearance of a newspaper N fully inserted against the back of the box 10.

Figure 2:
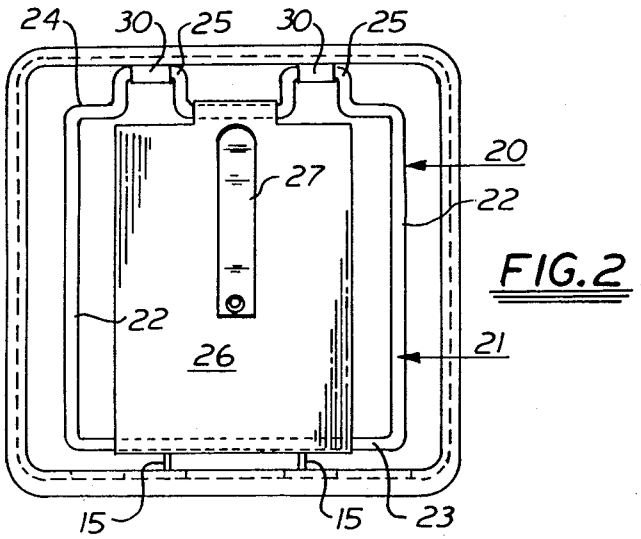
FIG. 2 is an end view of the embodiment shown in FIG. 1, taken from the open end thereof.

It is to be noted in FIG. 2 that the maximum width of the gate is less than the minimum width between the sides to provide ample clearances as the gate is swung between its approximately vertical and approximately horizontal positions and also that, by making the width of this panel 26 less than the distance between the sides 22 of the frame 21, additional spaces are provided between the side edges of the panel 26 and the sides of the box 10; these substantial spaces between the sides of the box and the adjacent edges of the panel are functional, as explained below.

In operation, the paper deliverer drives along the berm, at the edge of which the box 10 is mounted at a suitable height. Thus, the deliverer needs only to push a folded and rolled newspaper N into the open end of the box 10 against the gate 20 and thereby lift it as the newspaper is pushed against the closed end of the box. When the deliverer withdraws his hand by which the newspaper has been fully inserted into the box, the gate 20 falls by gravity to the closed, nearly vertical positio shown in FIG. 1, thereby signaling to the deliverer that the newspaper has inserted sufficiently far into the box. The subscriber, of course, simply lifts the gate 20 in order to reach in and remove the delivered paper.

There are no latches to operate in order to open the gate 20 and no springs are needed to close it. Because both the hinge clips 30 and the hinge tabs 25 loosely journaled therein are mounted on the underside of the roof 17, they are thereby substantially protected from the weather, particularly sleet or rain that may subsequently freeze. Consequently, it is highly unlikely that the gate 20 will ever become stuck to the extent that ready insertion of a newspaper will be impeded. Due to the small area of contact between the lower edge of the gate 20 and the ridges 15 on the floor 12, the amount of frozen rain or sleet which may occasionally collect at such points of contact is seldom sufficient to resist the automatic lifting of the gate 20 as the deliverer pushes the end of a folded or rolled newspaper against it.

The spring strap 27 permits a bill or note to be attached to the gate 20, where it will be readily noticed by the subscriber or the deliverer. Heretofore, such communications between the subscriber and deliverer, especially if placed in the box by the subscriber or left with the newspaper by the deliverer, have been frequently lost or overlooked.

While, over and beyound the protection provided by the box 10 and its eave 11, the panel 26 does provide some added protection to the interior of the box and an inserted newspaper from wind-driven rain, sleet, snow, and/or splashing from passing vehicles, the principal function of the gate 20 is, of course, to prevent an inserted newspaper from being blown or sucked out of the box by wind or, more particularly, by the turbulence of air created by passing cars and trucks. Once the newspaper has been inserted and the gate 20 has dropped into the position shown in FIG. 1, any suction from a passing vehicle, or eddies at the back of the box which are created by air entering the open end, can only move the newspaper toward the open end of the box as far as the closed gate 20. The function of the preferred spaces between the side edges of the panel 26 and the sides of the box 10 is to reduce the frontal area of the gate 20. Otherwise, if there were a strong wind blowing directly into the open end of a box or a sustained, substantially continuous blast into the box by passing vehicles and if the frontal area of a gate 20 were completely covered by a panel, the gate could be swung open to the position adjacent the roof 20 and held there long enough to permit eddies created at the back of the box to move the newspaper toward the open end so that the gate would no longer clear the newspaper as it fell toward its closed position. Either during such an initial blast or subsequent blasts, the newspaper could be blown out of the box.

By this invention, the one-way closure of a newspaper receptacle can be so effective as to eliminate, for all practical purposes, complaints of subscribers that delivered newspapers have been blown out of boxes and created troublesome litter. If such should occur, the presumption is that the deliverer had not inserted the newspaper sufficiently into the box until adequate insertion was signaled by gate falling to its maximum closed position.

Figure 3:
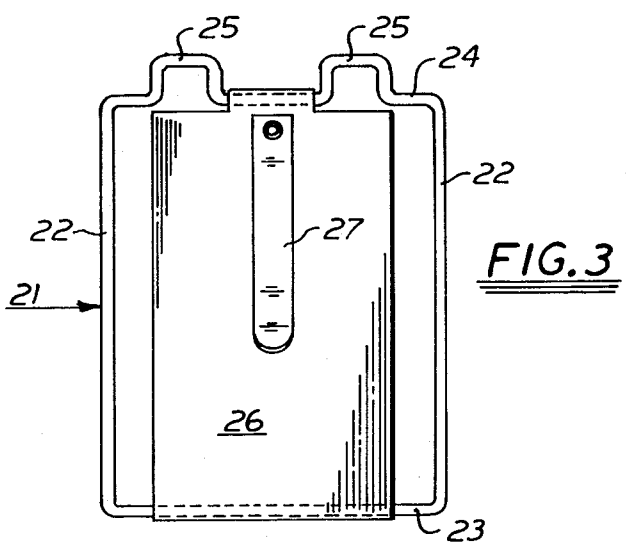
FIG. 3 is a detailed elevation of the closure shown in FIG. 2, but showing an optional modification thereof.

This invention is not confined to the preferred embodiment disclosed in FIGS. 1 and 2. Thus, in FIG. 3, the spring strap 27 is optionally riveted near the top of the gate 20: This optional variation nimimizes the possibility that an edge of a page of the newspaper may be caught by the open end of the strap and torn as the newspaper is inserted in the box.

Other optional modifications are that the frontal area of the gate may be further reduced by employing vertically extending wires instead of a panel 26 or a plurality of narrower panels may be used. Also, instead of employing a plurality of spaced hinge tabs 25 and associated hinge clips 30, a single wider and centrally located hinge tab and a correspondingly wider hinge clip may be employed. This invention may, therefore, be modified from the embodiments hereby disclosed without departing from the spirit and scope of the appended claims, in which the term "newspaper" is to be understood to encompass other matter not delivered by governmentally controlled postal service, such as, for example, advertising leaflets and brochures.

What is claimed is:

1. A newspaper delivery receptacle comprising the combination of a tubular structure adapted to be mounted so that it is longitudinally horizontal, said structure being open at a relatively vertical end and closed at its opposite end, and a substantially rigid gate extending transversely of the interior of said tubular structure, said gate being supported at its upper portion by hinge means having a substantially horizontal pivotal axis extending transversely of the interior of said tubular structure adjacent its open end, said gate having a length extending transversely to said axis which is greater than the distance from an edge of said gate, when pivotally mounted by said hinge means, than the distance from the horizontal plane in which said axis lies to a surface of the interior of the tubular structure which the gate will strike when pivoted about said axis, said gate also having a width, in any position to which it may be pivoted, less than the interior width of the tubular structure whereby, with the lower edge of the gate located in said tubular structure interiorly of said axis, said gate could fall by gravity to a vertical position but for the said greater length of said gate and said gate con be lifted only inwardly, the sides of the interior of said tubular structure being substantially vertically parallel and the cross-sectional area of said interior below said pivotal axis being sufficient to allow a newspaper to be passed therethrough, said cross-sectional area being substantially rectangular and the frontal area of said gate being less than the vertical cross-sectional area of said interior below said pivotal axis and in which the frontal area of said gate is predominantly comprised of members extending transversely to said axis.

2. A newspaper delivery receptacle as defined in claim 1 in which said gate is comprised of a rectangular frame, at least one up-standing hinge-pin member carried by the upper portion of said frame, at least one panel spaced from the side members of said frame and extending from the upper member to the lower member of said frame.

3. A newspaper delivery receptacle as defined in claim 2 in which a spring strap is secured to a panel to leave at least one end of the strap free and thereby permit a message to be clipped to said panel.

4. A gate for a tubular newspaper receptacle having a portion serving as a roof and a portion serving as a floor between an open front end and a closed back end, and sides extending between said roof and floor portions, a substantially rigid gate member, means for mounting said gate member for pivotal movement about a substantially horizontal pivotal axis which extends between the sides of said receptacle at a location in the upper portion of the cross-sectional plane of said receptacle in which said axis lies, and said gate having a length, in a direction transverse to said axis, which is greater than the vertical distance between said roof and floor portions and a width which is narrower than the distance between said sides and in which said mounting means comprise at least one hinge-pin portion carried by said gate and at least one bearing member in which said at least one hinge-pin portion is journaled and which is adapted to be secured to the said roof portion, said substantially rigid gate member being comprised of a frame, said at least one hinge-pin portion being located on the upper portion of said frame, and at least one panel extends from the upper portion of said frame to the lower portion of said frame.

5. A gate as defined in claim 4 in which a spring strap is secured to said panel by means which leave at least one end of said strap free from said panel, whereby a written message may be clipped to said panel by the at least one free end of said spring strap.

* * * * *